US006047618A

United States Patent [19]

Pieri

[11] Patent Number: 6,047,618

[45] Date of Patent: Apr. 11, 2000

[54] SOCKETS

[76] Inventor: Kenneth H. Pieri, 111 Porter Ave., Suite 266, Buffalo, N.Y. 14201

[21] Appl. No.: 09/088,672

[22] Filed: Jun. 2, 1998

Related U.S. Application Data

[60] Provisional application No. 60/047,366, Jun. 2, 1997.

[51] Int. Cl.[7] ..... B25B 13/06

[52] U.S. Cl. ..... 81/121.1; 81/DIG. 5

[58] Field of Search ..... 81/121.1, DIG. 5

[56] References Cited

U.S. PATENT DOCUMENTS

| | | | |
|---|---|---|---|
| 1,984,839 | 12/1934 | Murray | 81/DIG. 5 X |
| 4,947,713 | 8/1990 | Arnold | 81/DIG. 5 X |
| 4,982,627 | 1/1991 | Johnson | 81/DIG. 5 X |
| 5,031,488 | 7/1991 | Zumeta | 81/DIG. 5 X |
| 5,079,978 | 1/1992 | Kupfer | 81/DIG. 5 X |
| 5,181,439 | 1/1993 | Schwartz | 81/DIG. 5 X |
| 5,855,285 | 1/1999 | Laird et al. | 206/378 |

*Primary Examiner*—D. S. Meislin
*Attorney, Agent, or Firm*—John C. Thompson

[57] ABSTRACT

Improved sockets for driving nuts and the like, the sockets having improved markings so that the proper size and type of each socket can be easily identified and selected, even under adverse conditions, and so that each socket can be readily returned to its proper location after use. This is accomplished by placing size markings on four (4) differing sides of a cylindrical socket, the size markings being spaced about 90° apart. In addition, each of the sockets is color coded to facilitate reassembling the socket sets at the completion of work. In one example, colored plugs will be provided on each of the sockets either above or below the size markings. The sequence of colored plugs may repeat after three separate colors have been used if there is an obvious size difference between two sockets which are three sizes apart. In addition, the socket caddy is also be color coded. Finally, in order to distinguish between metric and english sockets, each socket is provided with a further identifying mark to indicate whether or not it is an english or metric socket. To this end, english sockets may be provided with 1 to 4 rings or grooves on the open end of the socket, i.e., the end of the socket which receives the nut to be driven, whereas metric sockets would be provided with 1–4 rings or grooves of the opposite end.

1 Claim, 2 Drawing Sheets

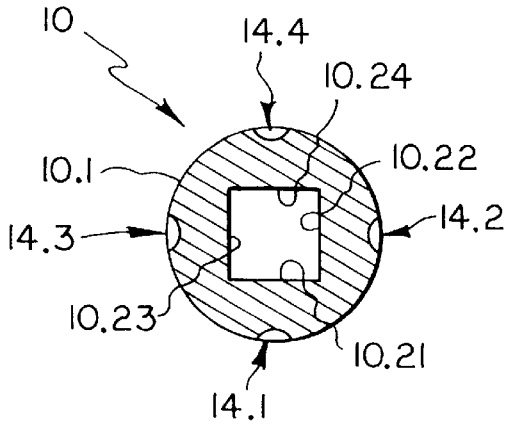
FIG. 5
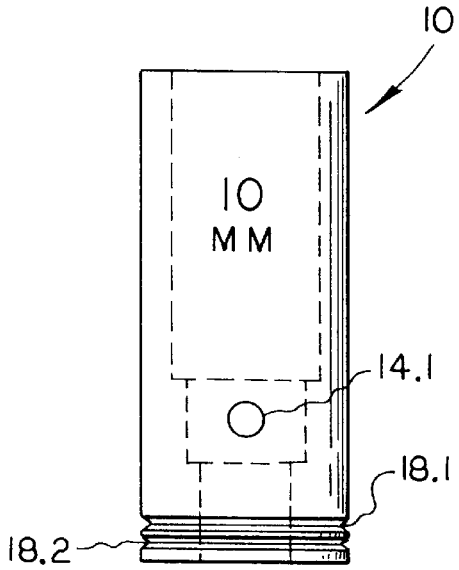
FIG. 6
FIG. 7
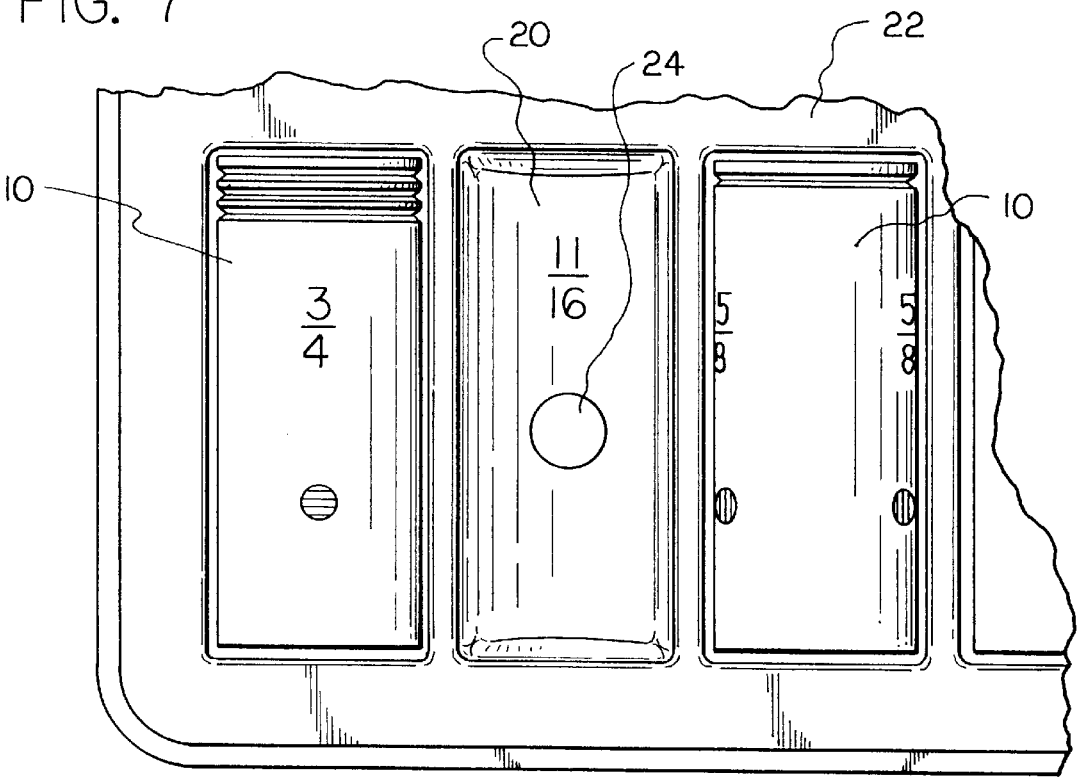

SOCKETS

This application is related to provisional application No. 60/047,366 filed Jun. 2, 1997.

TECHNICAL FIELD

The present invention relates generally to improved sockets for driving nuts and the like, and more particularly to a set of sockets having improved markings so that the proper size and type of each socket can be easily identified and selected, even under adverse conditions, and so that each socket can be readily returned to its proper location in its socket caddy after use.

BACKGROUND OF THE INVENTION

Sockets are well known in the art. The two most common types are english (or S.A.E.) and metric sockets designed for driving hexagonal nuts. As the nuts come in a variety of sizes, there is one socket for each size of nut.

For example, a ½ inch socket is provided for a ½ inch diameter nut, a 9/16 inch socket is provided for a 9/16 inch diameter nut, and ⅝ inch socket is provided for a ⅝ inch diameter nut. Similarly, a 10 mm socket is provided for a nut having a 10 mm diameter. The sockets are typically sold in sets. One popular inexpensive set has S.A.E. and metric sizes, the S.A.E. sizes running from 3/16 inch to ¾ inch, and the metric sizes running from 4 mm to 19 mm. In all, there are 16 S.A.E. sockets and 18 metric sockets. The tool box or socket caddy is provided with a series of recesses, there being one recess or retainer for each socket. The sockets in this set have indicia on one side only, which is typical, thus requiring that the socket be turned in a proper orientation so that its size may be read. Because of this, it is frequently difficult not only to select a socket for work, but also to properly put the socket back into its matching socket recess after a job has been completed. Also, it is difficult to tell metric from english sockets without reading the dimensions from the sockets. In many jobs today both english and metrics nuts are used requiring the worker to have two sets of sockets on hand during a job, or a combined set of the type referred to above. No matter how neat the worker may be, eventually the sockets become mixed, and it would facilitate his work if he could readily identify which sockets were metric, and which were english, and could also quickly identify the size without rotating the sockets.

OBJECTS AND SUMMARY OF THE INVENTION

It is an object of the present invention to provide new and improved markings on sockets so that both their size and/or type may be readily identified.

In summary, the foregoing object is accomplished by placing size markings on four (4) differing sides of the socket, the size markings being spaced about 90° apart on the cylindrical outer surface of the socket, the location of each marking being in-line with the internal flat side where the socket driver inserts into the socket. In addition, each of the sockets will be color coded to facilitate reassembling the socket sets at the completion of work. In one example, colored plugs (for example—ceramic) will be provided on each of the sockets, the colored plugs being placed either above or below the size markings. The colored plugs will be of differing colors.

For example, the smallest socket may have four red plugs, the next smallest socket may have four white plugs, and the third smallest socket may have four blue plugs. The sequence of colors may repeat after three separate colors have been used, thus the next three larger sockets in the set may have red, white and blue plugs in the same sequence. This sequence of colors may be repeated again and again since there is frequently an obvious size difference between two sockets which are three sizes apart. Thus, it is believed that only three colors need to be employed. In addition, the socket caddy may also be color coded. Finally, in order to distinguish between metric and english sockets it is proposed to have each socket provided with a further identifying mark to indicate whether or not it is an english socket or a metric socket. To this end, english sockets may be provided with 1 to 3 rings or grooves on the open end of the socket, i.e., the end of the socket which receives the nut to be driven. Similarly, metric sockets may be provided with 1–3 rings or grooves of the opposite end, i.e., the end of the socket nearest the opening which receives the driver.

The foregoing, as well as other objects and advantages of this invention will be more fully understood after consideration of the following detailed description is taken in conjunction with the accompanying drawings in which a preferred form of this invention is illustrated.

BRIEF DESCRIPTION OF THE DRAWINGS

FIG. 5 is a sectional view of the socket shown in FIG. 1, this view being taken generally along the line 5—5;

FIG. 6 is a front elevational view of a metric socket employing the novel features of this invention and FIG. 7 is a top view of a portion of a socket caddy.

DETAILED DESCRIPTION

Figure 1:
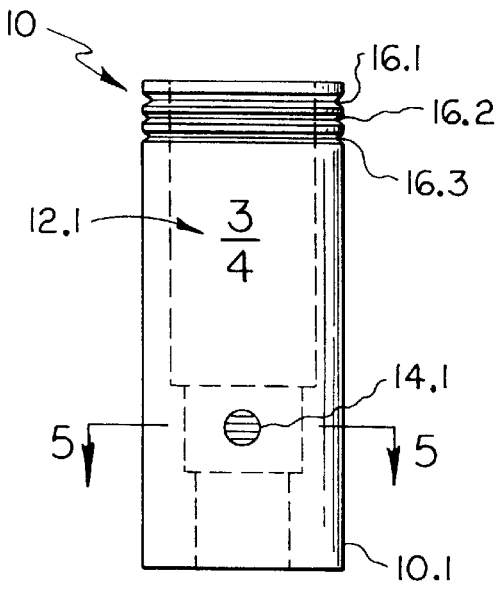
FIG. 1 is a front elevational view of an english socket showing the novel features of this invention.
Figure 2:
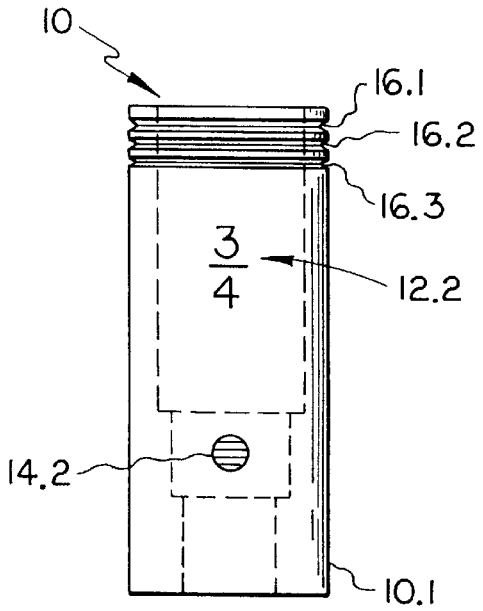
FIGS. 2–4 are right, left, and rear elevational views, respectively, of the socket shown in FIG. 1.
Figure 3:
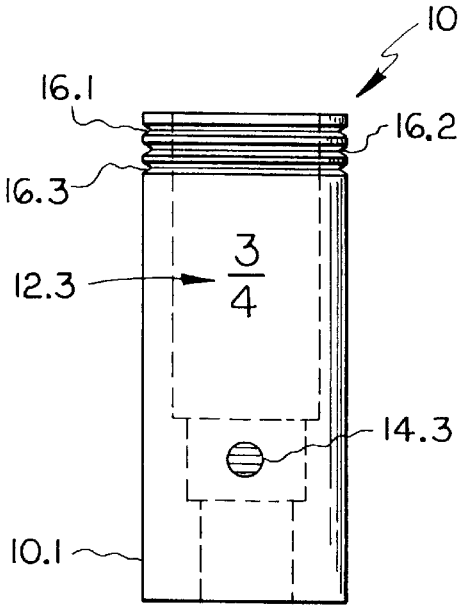
Figure 4:
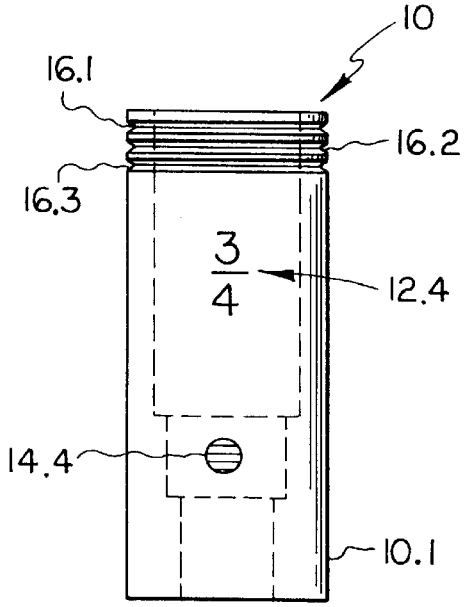

As can be seen from FIGS. 1–4, a socket 10 is provided with size markings of ¾ shown as 12.1, 12.2, 12.3, and 12.4. The size markings are placed on four (4) differing sides of each socket. Thus, the size markings are spaced about 90° apart on the cylindrical outer surface 10.1 of the socket. Each socket is provided with an aperture to receive a socket driver (not shown), the aperture being defined by flat sides 10.21–10.24 as shown in FIG. 5. The socket driver is typically carried by a ratchet wrench. The location of each of the size markings 12.1, 12.2, 12.3, and 12.4 as shown is in-line with an associated internal flat side 10.21, 10.22, 10.23, and 10.24, respectively.

As an additional option, each of the sockets 10 can be color coded to facilitate reassembling the sockets into sets at the completion of work. Thus, in the preferred embodiment illustrated in the various figures, four colored plugs 14.1, 14.2, 14.3, and 14.4 will be provided on each of the sockets, each of the plugs preferably being made of a ceramic material. Each colored plug is placed either above or (preferably) below the size markings. Thus, colored plug 14.1 can be placed below marking 12.1, colored plug 14.2 will be placed below marking 12.2, and so on. Each colored plug on a single socket will be of the same color. However, the colored plugs on differing sockets will be of differing colors. For example, the smallest socket in one embodiment is provided with four red plugs, the next larger socket is provided with four white plugs, and the third larger socket is provided with four blue plugs. In this embodiment the sequence of colors repeats after three separate colors have been used, thus the next three larger sockets in the set have red, white and blue plugs in the same sequence. This sequence of colors is repeated again and again because there is an obvious size difference between sockets three sizes apart. Thus, in most socket sets, it is believed that only three differing colors need to be employed. It should also be observed, that the colored plugs are also in line with the flats 10.21, 10.22, etc.

In order to facilitate the return of the sockets to recesses 20 in a socket caddy 22, each recess may have a colored indicia 24 which will correspond to the colored plug of the socket to be received in the recess. In addition, the recess may also have the size of the socket embossed on the bottom of the recess as shown. The embossing may alternatively take place to one side of the recess, not illustrated.

In order to distinguish between metric and english (or S.A.E.) sockets, each socket has a further identifying markings to indicate whether or not it is an english socket or a metric socket. To this end, english sockets may be provided with 1 to 3 rings or grooves on the open end of the socket, i.e., the end of the socket which is adapted to receive a nut, three rings or grooves 16.1, 16.2, and 16.3 being shown in FIGS. 1–4. Metric sockets would be provided with 1–3 rings or grooves of the opposite end, i.e., the end nearest the opening which receives the driver, and in FIG. 6, 2 rings or grooves 18.1, and 18.2 are illustrated. Also when red indicia is used the socket will be provided with a single groove as shown to the right in FIG. 7, when white indicia is used the socket will be provided with two grooves as shown in FIG. 6, and when blue indicia is used the socket will be provided with three grooves as shown in FIGS. 1–4 and to the left in FIG. 7.

It should be appreciated from the above, that when using sockets during work it will be easy to identify the size and type of socket needed for the work. Also, at the completion of a job, it will be easy to reassemble the sockets into the socket caddy until the next time they are required to be used.

While the best modes of this invention known to applicant at this time has been shown in the accompanying drawings and described in the accompanying text, it should be understood that applicant does not intend to be limited to the particular details illustrated in the accompanying drawings and text. Thus, it is the desire of the applicant of the present invention that it be clearly understood that the embodiments of the invention, while preferred, can be readily changed and altered by one skilled in the art, and that these embodiments are not to be limiting on the form or benefits of the invention.

What is claimed is:

1. A set of sockets including metric and S.A.E. sockets, the size and type of which may be readily and quickly identified either during work, or at the completion of work when it is necessary to place one or more sockets back into a socket caddy; the set of sockets comprising:

a plurality of differing sized cylindrical sockets, each having a driver socket at one end and a workpiece engaging socket at the other end, adjacent sized sockets being marked by three differing colors in series to facilitate identification, and wherein each socket is provided with a selected one of one groove, two grooves, or three grooves to indicate whether the socket is metric or S.A.E., said metric sockets having the grooves adjacent one end, and said S.A.E. sockets having the grove or grooves adjacent the other end, there being one groove for sockets with the first color in the series, two grooves for sockets with the second color in the series, and three grooves for sockets with the third color in the series; and size markings spaced equally 90° apart about the surface of the cylindrical socket so that the size of the socket may be readily identified no matter what the orientation of the socket.

* * * * *